US005590517A

United States Patent [19]

DeFreitas

[11] Patent Number: 5,590,517

[45] Date of Patent: Jan. 7, 1997

[54] IGNITION METHODS AND APPARATUS FOR COMBUSTORS

[75] Inventor: Dennis M. DeFreitas, Oxford, N.Y.

[73] Assignee: Simmonds Precision Engine Systems, Inc., Akron, Ohio

[21] Appl. No.: 470,403

[22] Filed: Jun. 6, 1995

Related U.S. Application Data

[62] Division of Ser. No. 67,652, May 26, 1993, Pat. No. 5,515, 681.

[51] Int. Cl.[6] ..... F02C 7/26

[52] U.S. Cl. ..... 60/39.06; 60/39.826

[58] Field of Search ..... 60/39.821, 39.826, 60/39.828, 740, 742, 39.06; 239/706, 707, 690, 692

[56] References Cited

U.S. PATENT DOCUMENTS

| | | | |
|---|---|---|---|
| 3,167,015 | 1/1965 | Smith et al. | 102/49 |
| 3,258,910 | 7/1966 | Seymour . | |
| 3,473,879 | 10/1969 | Berberich | 431/1 |
| 3,750,392 | 8/1973 | Zoll | 60/39.82 |
| 3,861,371 | 1/1975 | Gamell | 123/148 E |
| 4,008,991 | 2/1977 | McAleer | 431/1 |
| 4,023,351 | 5/1977 | Beyler et al. | 60/742 |
| 4,035,131 | 7/1977 | Cerkanowicz | 431/6 |
| 4,082,070 | 4/1978 | Saufferer et al. | 123/119 E |
| 4,124,003 | 11/1978 | Abe et al. | 123/119 E |

(List continued on next page.)

FOREIGN PATENT DOCUMENTS

0026595A1 9/1980 European Pat. Off. .

OTHER PUBLICATIONS

European Search Report For European Application No. 94303728.3.

"Laser Induced Ignition Of Monodisperse Kerosene Fuel Sprays", thesis presented to the faculty of the Graduate School of Cornell University by Ellen Roosman Mell, May 1991.

"Radiative Sources To Ignite Gas Turbines", Technology Today, Textron Lycoming, vol. II, No. 3, Oct. 1987.

Technology Today, Textron Lycoming, vol. V, No. 1, Fall 1990.

"Electrostatic Spraying Of Oil–Based Agricultural Products", H. C. Simmons et al, Pesticide Formulations, vol. 5, (no date).

"The Electrostatic Atomization Of Hydrocarbons", Journal of the Institute of Energy, (312) Jun. 1984.

*Primary Examiner*—Timothy S. Thorpe

*Attorney, Agent, or Firm*—Leonard L. Lewis; William E. Zitelli

[57] ABSTRACT

Apparatus for igniting fuel in a combustor includes an injector having an electrostatic fuel atomization nozzle and an igniter. The injector produces an initial combustion process that ignites the main fuel supply from a fuel nozzle. Alternatively, a main fuel nozzle is provided which includes a plurality of electrostatic fuel nozzles disposed about a centrally located igniter. In one embodiment, the igniter is a laser igniter.

6 Claims, 5 Drawing Sheets

U.S. PATENT DOCUMENTS

| | | | |
|---|---|---|---|
| 4,150,644 | 4/1979 | Masaki et al. | 239/696 |
| 4,173,206 | 11/1979 | Masaki | 123/119 E |
| 4,255,777 | 3/1981 | Kelly | 361/228 |
| 4,302,933 | 12/1981 | Smith | 60/261 |
| 4,314,530 | 2/1982 | Giacchetti | 123/143 R |
| 4,343,687 | 8/1992 | Ronn | 204/157.1 R |
| 4,344,401 | 8/1982 | Masaki | 123/536 |
| 4,380,786 | 4/1983 | Kelly | 361/228 |
| 4,380,978 | 4/1983 | Maynard, Jr. et al. | 123/536 |
| 4,416,226 | 11/1983 | Nishida et al. | 123/143 B |
| 4,434,753 | 3/1984 | Mukainakano et al. | 123/143 B |
| 4,439,980 | 4/1984 | Bilbarz et al. | 60/740 |
| 4,508,265 | 4/1985 | Jido | 239/708 |
| 4,556,020 | 12/1985 | Hickling | 123/143 B |
| 4,581,675 | 4/1986 | Kelly | 361/228 |
| 4,605,485 | 8/1986 | Cerkanowicz | 204/302 |
| 4,618,432 | 10/1986 | Mintz et al. | 210/748 |
| 4,627,903 | 12/1986 | Chapman et al. | 204/275 |
| 4,630,169 | 12/1986 | Kelly | 361/225 |
| 4,666,678 | 5/1987 | Lemelson | 422/186 |
| 4,702,808 | 10/1987 | Lemelson | 204/157.41 |
| 4,726,336 | 2/1988 | Hoppie et al. | 123/292 |
| 4,825,658 | 5/1989 | Beebe | 60/748 |
| 4,938,019 | 7/1990 | Angell et al. | 60/39.06 |
| 4,947,640 | 8/1990 | Few et al. | 60/39.821 |
| 4,991,774 | 1/1991 | Kelly | 239/3 |
| 5,093,602 | 3/1992 | Kelly | 313/231.01 |
| 5,234,170 | 8/1993 | Schirmer et al. | 239/690 |
| 5,257,500 | 11/1993 | Venkataramani et al. | 60/39.821 |
| 5,367,869 | 11/1994 | Defreitas | 60/39.06 |

IGNITION METHODS AND APPARATUS FOR COMBUSTORS

This is a divisional of application Ser. No. 08/067,652 filed on May 26, 1993, now U.S. Pat No. 5,515,681.

BACKGROUND OF THE INVENTION

The invention relates generally to apparatus and methods for igniting air/fuel mixtures in combustors. More particularly, the invention relates to the use of electrostatic atomization in such apparatus and methods.

A gas turbine engine is an example of an engine where ignition and engine restart can be a critical safety concern. For example, in aerospace applications, if a flame out occurs in an airborne jet engine, it may be necessary to restart the engine under extremely adverse conditions such as low ambient temperatures, thin atmospheric condition, and low fuel pressures as engine speed decelerates.

A combustor is a fundamental assembly used in turbine and other engines. The combustor typically includes a can or other annular casing that forms part or all of the combustion chamber. Within the combustor are one or more fuel nozzles which deliver fuel to the combustion chamber, along with air vents for delivering high pressure air to the combustion chamber. The fuel/air mixture is ignited near the region of the combustor closest to the fuel nozzles (i.e. the primary zone). The combustion process continues as the combusting fuel/air mixture moves down to the intermediate zone where additional air is supplied to cool the combustor wall and aid the combustion process. The process continues as the mixture of hot combustion gases enters the dilution zone where dilution air is supplied to cool the exhaust gases to protect the annulus casing from melting and downstream to protect the turbine blades. As is well known, homogeneity of the fuel burn within the combustion chamber is an important design criteria for a turbine engine.

Fuel delivery systems play an important part in the ability to initiate or restart a turbine engine. In known combustors, the fuel nozzles typically include a primary orifice and one or more secondary orifices. The purpose of the nozzle is to initially provide a fine fuel spray that can be ignited for engine start. After combustion starts and the engine speed increases, the secondary orifices are opened to increase fuel flow for engine idle and full throttle conditions.

The ease with which fuel can be ignited in the combustor depends on several key factors including fuel temperature, the type of igniter used, amount of ignition energy delivered, point of ignition energy delivery and the degree to which the fuel is atomized by the nozzle via the primary orifice. The atomization process is also important with respect to the overall efficiency of the fuel combustion.

Known aerospace gas turbine atomizing fuel nozzles include fuel pressure atomizers and air blast atomizers and combinations thereof. A fuel pressure atomizer uses a combination of high fuel pressure and an orifice to force atomization to occur. Fuel pressure at the orifice raises the energy of the fuel as it exits the nozzle, resulting in shearing of the liquid into small droplets. Droplet sizes are distributed in the form of a bell shaped curve. Thus, there will be large and small droplet size distributions around an average size droplet. The size distribution affects combustion because the larger the droplet size, more energy is needed and the more difficult it is to ignite and burn. Also, if the droplet sizes are too large, or if the air/fuel mixture is fuel rich, either condition will result in low burn efficiency and incomplete combustion. Incomplete combustion of the fuel produces black smoke (i.e. soot.) Increased levels of soot production cause a variety of operational problems for gas turbine engines (e.g. plug fouling, higher gas flow temperatures and increased infrared signatures). Fuel pressure atomizers must also have an operating pressure that can overcome the pressure build up that occurs in the combustion chamber. When flame out occurs, fuel pressure and air flow deteriorate rapidly, affording very little time to restart the engine. This is further exacerbated when the flame out occurs at thin atmospheric altitudes, creating a very lean operating environment.

Air blast atomizing nozzles use air pressure to atomize the fuel. Typically, such nozzles include an annulus for high speed air. The high air velocity provides the energy required to atomize the fuel stream into small particles. The air blast atomizer thus does not require high fuel pressures. However, the need for high speed air makes the air blast nozzle less than ideal for engine restart at high altitudes.

Low temperature ambient conditions present further difficulty for ignition and restart using conventional nozzles. This is because at low temperature the fuel viscosity can increase substantially, thus making atomization more difficult.

Combustors also require an igniter device to initiate the combustion process. Known igniters are plasma type spark plugs and glow plugs. Typically, the spark plug is mounted in the combustor wall near the fuel nozzle. In a conventional combustor, the primary zone or optimum region for ignition is the high turbulence region just forward of the nozzle outlet. However, the igniter cannot protrude down into this optimum region because it would be destroyed by the fuel combustion process. Retractable igniters are sometimes used with furnaces, but are not deemed reliable for aerospace applications. Thus, particularly in aircraft engine combustors, the igniter is mounted in a recess on the wall of the combustor near the primary zone. A high energy plasma, high temperature spark kernel is created at the periphery of the combustor wall and protrudes into the combustion chamber. However, there are numerous disadvantages including the fact that the combustor wall tends to act as a heat sink and quenches the intensity of the spark. The fuel/air mixture also is not optimum in this region. Obviously, the combustors are designed so that this type of ignition arrangement works, but it is less than ideal.

A known alternative to the spark kernel is the use of a torch burner which creates a flame that is used to ignite the main fuel supply in the primary zone of the combustion chamber. Known torch burners, however, still produce less than ideal results because of their reliance on conventional fuel supply nozzles and orifices. Under adverse conditions such as low temperature and high altitude they can experience relight difficulties.

Conventional plasma type spark plugs are commonly used for igniters. Unfortunately, by their very nature of using high voltage/current plasma discharge, they exhibit considerable electrode degradation and must be routinely replaced. Also, less than optimum combustion, particularly during engine start up and shut down, and/or fuel exposure, can produce plug fouling which degrades the spark discharge intensity or can prevent ignition. Varnish and other combustion by-products, particularly due to incomplete combustion and fuel evaporation, also can deteriorate plug performance. As a result, very high energy must be delivered to the spark plug to insure that carbon and fuel deposits are literally blown off the electrodes to produce an adequate spark. This excess energy, however, causes more rapid degradation of the electrodes, thereby shortening their useful life and increasing maintenance. Furthermore, the high energy required to produce the spark is typically supplied from an exciter circuit, such as a capacitive or inductive discharge exciter. The exciter circuit is located remote from the combustion chamber, however, due to the associated electronics. Consequently, the exciter must be connected to the plug by way of long coaxial cable leads or wires. This wiring causes many problems, not the least of which is simply energy loss. For example, to produce a two joule discharge at the plug, the exciter circuit may be required to produce ten joules of power, resulting in low ignition system efficiency, hence higher weight and cost.

The need exists, therefore, for better and more reliable and more efficient apparatus and methods for initiating combustion, particularly for engine restart under adverse conditions. The need also exists for an improved igniter that does not have the problems associated with conventional plasma type plugs.

SUMMARY OF THE INVENTION

The present invention contemplates a significant departure from conventional combustion ignition systems by providing in a preferred embodiment, a combustor, a device for starting combustion having an electrostatic fuel nozzle connectable to a fuel supply, and means for igniting fuel from the nozzle. The invention further provides a preferred embodiment of a flame injector for starting combustion in a combustor including an electrostatic fuel atomizer connectable to a fuel supply and an igniter for igniting atomized fuel from the atomizer.

In accordance with another aspect of the invention, an ignition system for use with a combustor includes nozzle means for electrostatically atomizing fuel, the nozzle means being connectable to a fuel supply; igniter means for igniting atomized fuel from the nozzle means; and energy means for providing electrical energy to the nozzle means and energy to the igniter means.

The invention further contemplates the methods for using such apparatus, and a preferred method for igniting fuel in a combustor comprising the steps of using an electrostatic nozzle to atomize fuel provided from a fuel supply; using an igniter to initiate combustion of the atomized fuel; and using the initial combustion to ignite fuel from a main fuel supply in the combustor.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION AND PREFERRED EMBODIMENTS

Figure 1:
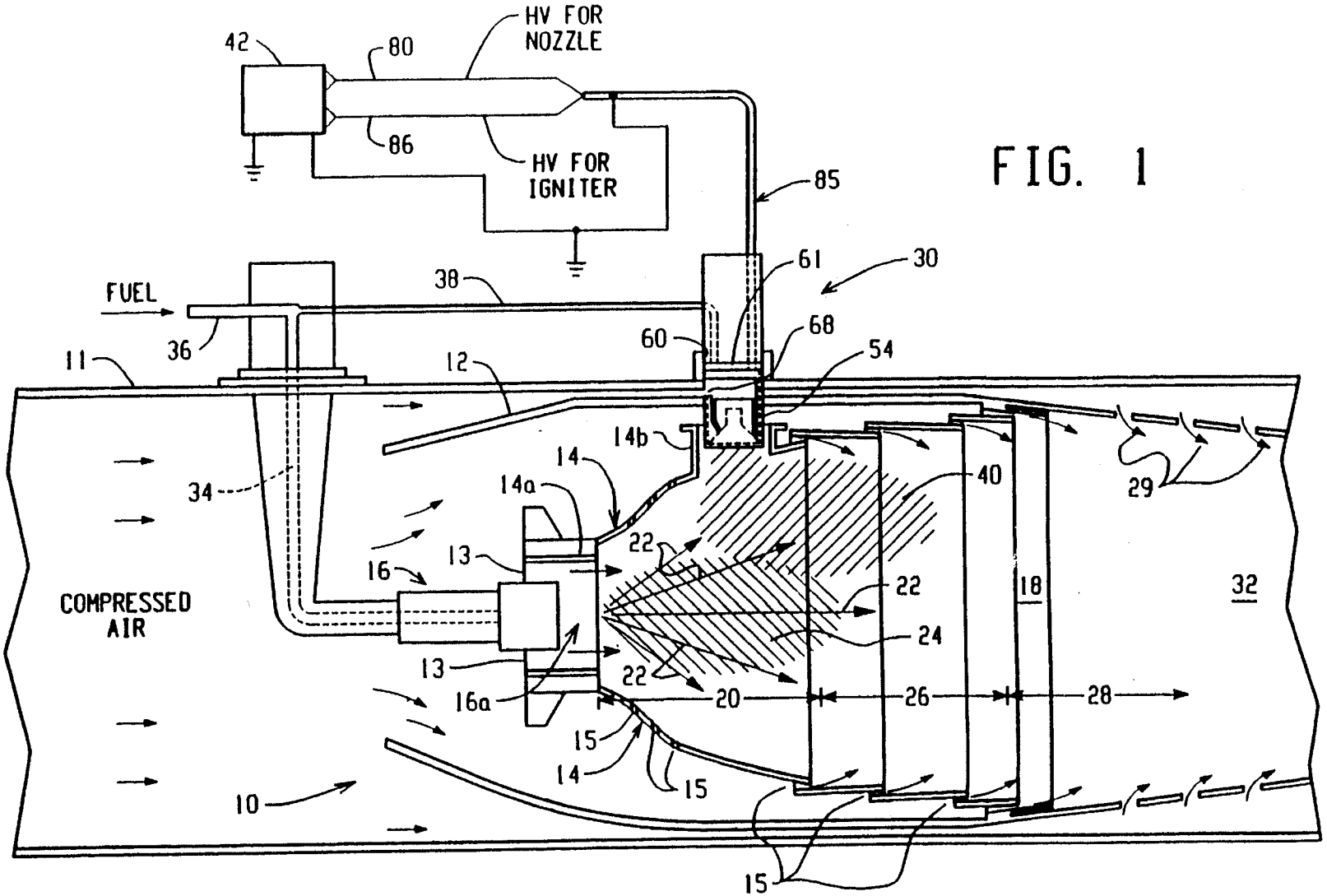
FIG. 1 is a simplified schematic representation of a portion of a combustor, in partial section, showing an embodiment of the invention therein.

With reference to FIG. 1, a combustor such as may be used in a gas turbine engine is generally designated with the numeral 10. It is important to note that while the invention is described herein with reference to a gas turbine engine, and in particular a can combustor in a gas turbine engine suitable for use on aircraft, such description is merely for convenience and ease of explanation and should not be construed in a limiting sense. The invention is related to the combustion initiation and restart process, rather than being limited to specific engine or combustor designs. Those skilled in the art will readily appreciate that the invention can be used with different types of combustors for many types of engines and applications other than in the aerospace and airborne applications, such as, for example, industrial combustion engines. A few gas turbine engine applications of interest are: jet engines including afterburners for jet engines, turbojets, turboprops, turbofans, large gas turbine, medium gas turbines, small gas turbines, marine gas turbines, stationary and mobile industrial gas turbines. Combustor systems of interest are: residential and industrial furnace applications, can combustors, can annular combustors, annular combustors and dual annular combustors to name a few. These lists are not intended to be exhaustive, of course, nor are they to be construed in a limiting sense as to the scope of the invention.

A typical turbine engine combustion chamber includes within a fan casing or air plenum 11 an outer combustor liner 12 that encloses an inner combustor liner 14. The space between the outer and inner combustor liners 12, 14 is exaggerated in FIG. 1 for clarity. For further clarity and convenience, only one combustor is shown in FIG. 1. Other combustor designs, of course, could be used and include, for example, annular combustors which would have a plurality of fuel nozzles therein arranged in an annular configuration within the casing 12 (without the can design). The particular type of combustor used will depend on the engine design or combustion application. The invention is suitable for use with many different types of combustors, therefore, the description herein of a can combustor should not be construed in a limiting sense.

The combustor liner 14 is provided with a plurality of carefully designed air vents 15 that permit combustion air to enter the combustor and mix with fuel. The flow of air from the plenum 11 through the combustor (shown by the arrows in FIG. 1) via the air vents 15 and other ports, is a careful design criteria established by the combustor designer to ensure the proper air/fuel mixture under various operating conditions and flight envelopes. Fuel is supplied by one or more fuel nozzle assemblies 16 installed through openings in the inner liner 14. Typically associated with each fuel nozzle assembly 16 are additional air inlets 13 to create a high air flow and turbulence in the proximate area of the nozzle to facilitate air/fuel mixture and uniform combustion. Aerodynamic swirlers 14*a* can also be incorporated as part of the combustor liner (or alternatively part of the nozzle assembly 16) to enhance the air/fuel mixing. In the embodiment of FIG. 1, each fuel nozzle assembly 16 may be any conventional nozzle such as a fuel pressure nozzle, air blast nozzle or other type, and is usually specified by the engine manufacturer. The nozzle assembly 16 includes appropriate fittings that couple fuel lines (34) to the nozzle assembly in a known manner. A typical main fuel nozzle design is shown, for example, in U.S. Pat. No. 4,825,628 issued to Beebe. Other nozzle designs are illustrated in "The Jet Engine", published by Rolls-Royce, PLC, Derby, England, the entire disclosure of which is fully incorporated herein by reference, which is but one of many publications that describe nozzle designs. The present invention can be used With many different nozzle designs, however.

The combustor liner 14 defines a combustion chamber 18 that includes three main zones, as is well known to those skilled in the art. The primary zone 20 is located just forward of the nozzle outlet 16*a*. This primary zone is a region of high fuel concentration and high air flow, volume and turbulence. Fuel is preferably dispersed into the primary region as represented by the directional arrows 22 so as to provide an optimum area for igniting the fuel, as represented by the shaded region 24. The nozzle 16 preferably provides atomized fuel in the form of a small droplet spray, however, conventional nozzles as used for the nozzle 16 are limited in the size of the droplets and by operating conditions such as the chamber 18 pressure and fuel temperature. In accordance with an important aspect of the invention, a flame or combustion injector, generally indicated with the numeral 30, is provided to initiate the main fuel supply ignition process, as will be explained shortly hereinafter. As used herein the term "flame" should not be construed in a limiting sense. An ignition flame can be any high temperature combustion effect from combustion of an air/fuel mixture, whether a visible flame is produced or other combustion process producing high energy and temperature release to ignite the main fuel supply.

Just downstream of the primary zone is an intermediate zone 26. In this zone, dilution air (represented by the arrows near the openings and vents 15) is provided to the combustor through the air vents 15. This air is used both to facilitate a homogenous combustion and also to cool the combustor liner 14. After the intermediate zone the combustion by-products pass through a dilution zone 28 where further dilution air 29 is provided to cool the hot gases sufficiently before they pass through the combustor outlet 32 to the turbine blades.

Each fuel nozzle 16 receives fuel from a nozzle fuel line 34 connected to a main fuel line 36. An auxiliary fuel line or branch 38 supplies fuel to the combustion injector 30. The fuel lines 34 and 38 are coupled to the nozzle 16 and injector 30 respectively by an appropriate fitting (not shown in FIG. 1).

In the embodiment shown in FIG. 1, the combustion injector 30 replaces the normal spark igniter located near the fuel nozzle 16 and produces an ignition flame or combustion represented by the shaded region 40. This initial combustion intersects with or is injected into the optimum fuel dispersion region 24 and ignites the main air/fuel mixture in the primary zone 20. A power source 42 is connected to the injector 30 and includes electrical power for the injector nozzle, as well as additional energy inputs for the igniter integrally contained therein (as will be explained herein).

Figure 2:
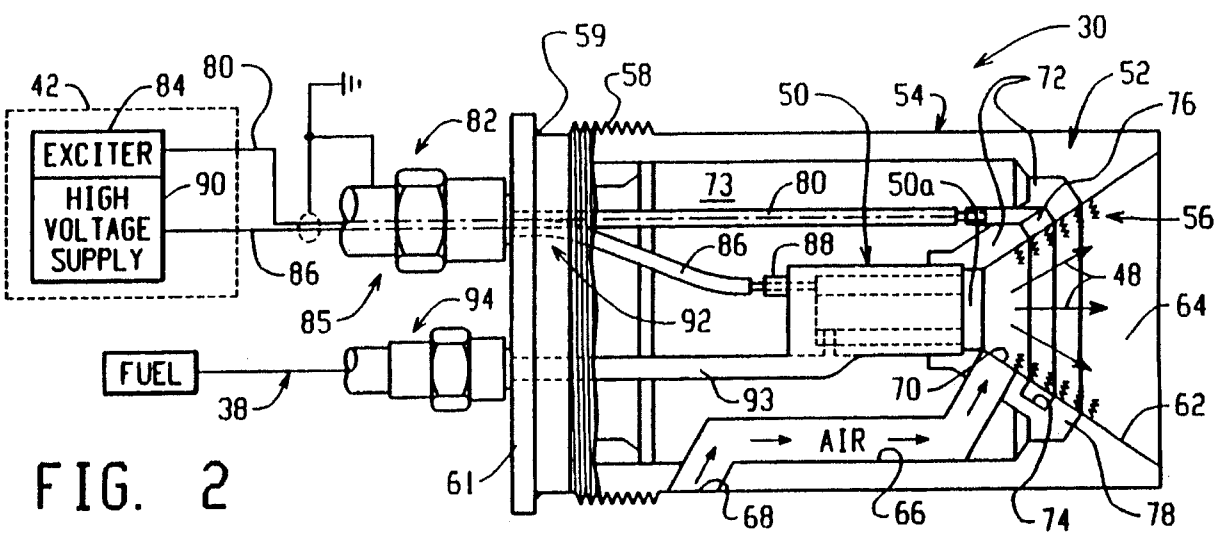
FIG. 2 is a more detailed illustration in longitudinal section of an injector system according to the present invention.

FIG. 2 shows a preferred embodiment of the injector 30. The injector 30 is preferably an integral unit that includes an electrostatic nozzle ("ESN") assembly 50 and an igniter mechanism or assembly 52 disposed within a housing 54. In the embodiment of FIGS. 1 and 2, the igniter mechanism 52 is preferably realized in the form of a plasma discharge type spark plug that creates a plasma discharge 56 near the outlet orifice 50*a* of the nozzle. In this embodiment, the orifice 50*a* is cylindrical with the spray emitted generally parallel with the central axis of the injector 30 (as represented by the arrows 48). However, other types of igniters can be used in combination with the nozzle 50, including, but not limited to, a conventional spark plug or a laser igniter, to name two other examples. Other igniter mechanisms certainly can be used. The laser igniter concept for use with the injector is described herein with respect to FIG. 7. Also, the invention is not limited to the particular nozzle orifice design described and shown herein. For example, the nozzle outlet orifice 50*a* can be conical (to produce a hallow core spray), a slit, or other geometric openings resulting in various spray patterns. The particular orifice 50*a* design used in an injector 30 will be determined by the engine application and design requirements.

The housing 54 has a cylindrical envelope with a threaded male portion 58 that threadably engages a female receptacle 60 in the plenum wall 11 (FIG. 1). The housing 54 further extends through the outer combustor liner 12 and the inner combustor liner 14 through openings therein, such that the air vent port 68 opens to the plenum air supply. This permits easy installation and removal of the injector 30 for maintenance and repair. The inner liner opening 14*b* (FIG. 1) for the injector 30 may conveniently be the same opening normally used for mounting a conventional igniter.

The housing 54 may further include a lapped pressure seal 59 that seals the plenum connection with a collar 61 to prevent venting to atmosphere after the injector 30 is fully seated.

Alternatively, of course, the injector 30 can be installed with a blind mounting arrangement with a key to insure proper orientation of the air port 68 to the plenum 11, with the injector being retained by a threaded sealing engagement or other retaining mechanisms. The particular mounting arrangement selected is largely a matter of design choice as a function of the particular engine design. The mounting arrangement preferably should be such that the air vent 68 opens to the correct air supply and the injector does not protrude past the inner combustor liner 14.

The housing 54 further includes an inner frustoconical contour or surface 62 that defines an outlet orifice 64 for the injector 30. A multiple orifice injector could alternatively be used. The housing 54 further includes an air vent 66 that opens at an inlet end 68 to the main air supply plenum outside the combustor liner 14 (see FIG. 1). The air vent 66 opens at its other (outlet) end 70 to the injector outlet orifice 64, thereby supplying air needed for igniting fuel from the nozzle 50. Additional vents 66 may be provided as needed. The outlet port 70 preferably is located between the nozzle outlet 50*a* and the igniter 52 discharge zone.

The housing 54 is preferably made of a high temperature, high conductivity material such as stainless steel. The nozzle assembly 50 and igniter 52 are preferably mounted in a high temperature, electrically insulative spacer 72 which is assembled into the housing 54 by any convenient means such as brazing. The spacer 72 preferably is made of a fired ceramic such as alumina ($Al_2O_3$) having metalized surfaces for brazing to the housing 54 and the nozzle 50. The ceramic spacer 72 will not degrade from exposure to the high temperatures and fuel at the injector orifice 64. The spacer 72 also provides excellent electrical isolation because the housing 54 is electrically grounded and the nozzle 50 uses high voltage potentials, as does the igniter 52.

The housing is preferably hermetically sealed and filled with dry nitrogen or other appropriate inert gas. Alternatively, the housing 54 may be filled with alumina 73 or similar ceramic power packing material. The entire housing could be made of ceramic, rather than stainless steel, and machined or molded to the desired configuration for holding the igniter and nozzle. In the latter case, cavities can be formed for passing conductors and fuel and/or optic fibers or simply passing laser energy through the housing, to the igniter and nozzle assemblies.

The spacer 72 includes an annular recess 74 that retains an igniter electrode 76. The electrode 76 preferably is made of a low erosion metal suitable as a spark electrode such as but not limited to tungsten alloy, Hastalloy® or Iridium alloy. The ceramic spacer 72 isolates (as indicated at 78) the electrode 76 from the housing 54 so that a high voltage differential can be created across the ceramic gap 78. When the potential exceeds a predeterminable value, the plasma arc 56 is created with sufficient temperature to ignite fuel from the nozzle 50. The electrode 76 and ceramic gap 78 can be replaced by a semiconducting igniter which will allow plasma discharges to occur at higher combustor pressures. Such a semiconducting igniter is commercially available from S. L. Auburn, Auburn, N.Y.

A high voltage lead or cable 80 is electrically connected at one end to the electrode 76. The other end of the lead 80 connects through a high voltage hermetic electrical connector 82 and is connected to the output of an exciter circuit 84. The cable 80 passes through the housing 54 via tubular cavities formed therein. The exciter circuit may be any conventional high voltage/current discharge circuit such as a capacitive discharge circuit that periodically or selectively supplies high voltage/current pulses to the electrode 76. Such exciters are well known in the art, such as the exciter shown in U.S. Pat. No. 5,030,883 issued to Bonavia et al. and commonly owned by the assignee of the present invention, the entire disclosure of which is fully incorporated herein by reference. The specific type of exciter used with the present invention, however, is primarily a matter of design choice based on the engine design and operating parameters. Thus, other exciter designs such as unidirectional, inductive, high tension and low tension, to name just a few, can be used with the invention.

The electrostatic atomization fuel nozzle 50 is a conventional device that produces a very fine fuel spray that is easier to ignite than a conventional pressure nozzle. The nozzle 50 may be, for example, the type of nozzle described in U.S. Pat. Nos. 4,255,777; 4,380,786; 4,581,675; 4,991,774 and 5,093,602 issued to Kelly, the entire disclosures of which are fully incorporated herein by reference. Such nozzles are commercially available from Charged Injection Corporation, such as a series 18 Spray Triode® and a SPRAYTRON™ nozzle. In simple terms, the electrostatic nozzle injects electrons into the fuel thereby electrostatically charging the fuel. In the case of the Spray Triode®, the electrons are injected, for example, by disposing a high voltage conductor in contact with the fuel of the nozzle. Of course, other injection techniques may be used. Once charged the fuel exits the nozzle orifice where electrostatic repulsive forces begin to act on the fuel stream. Since these repulsive forces far exceed the hydrodynamic forces which normally determine fuel droplet size the result is stream fragmentation into very small droplets with a narrow droplet distribution. Consequently, fuel droplet size has been found to be virtually independent of fuel viscosity and the nozzle operating pressure (i.e. delta pressure). As the droplet size decreases from 120 microns to 20 microns the required ignition energy decreases from 100 millijoules to less than 10 millijoule. In a conventional plasma spark igniter based systems the minimum energy required for ignition is dwarfed by the energy required to fire the spark igniter and ignite the fuel over all operational conditions and design constraints (i.e. igniter placement, fuel fouling, carbon fouling, high pressures and high temperatures). However, the integration of electrostatic atomization and plasma spark igniter to form a flame or combustion injector accentuates the positive aspects of each system. The electrical charge is applied to the fuel by means of a high voltage conductor 86 that is connected at one end to a terminal 88 in the nozzle 50. The other end of the conductor 86 is connected through the high voltage electrical connector 82 and is connected to a high voltage supply 90. The conductor 86 also passes through the housing via tubular cavities similar to the igniter conductor 80. The high voltage supply 90 may be conventional in design. Typically, the nozzle 50 requires about 5000 to 20,000 VDC and microamperes of current for producing a fuel spray with droplet sizes of about 50 to 20 microns.

As illustrated in FIG. 2, the conductor 86 and lead 80 can be part of an integral cable 85 with a grounded metallic shield to limit electromagnetic emissions to acceptable levels. This electromagnetic energy is conducted to the electrical system ground reference via the metallic shield, connector backshell, connector shells (i.e. at both the injector 30 and the high voltage power supply 90 and the exciter 84), and unit mounting structures. Internal to the injector 30 the conductor 86 and lead 80 will branch as at 92. Furthermore, the high voltage supply 90 may conveniently be part of the exciter circuit 84, with the dual cable shielded 85 providing a return path for ignition pulse discharges.

Fuel for the electrostatic nozzle 50 is supplied from the auxiliary supply line 38 (FIG. 1) through a suitable fitting 94 into a housing cavity or metal tube 93 to the nozzle 50. Detailed operation of the nozzle 50 is provided in the referenced patents.

With reference to FIGS. 1 and 2, operation of the injector 30 and combustor 10 will now be described. Assuming an initial condition of engine start up, fuel is supplied to the main fuel nozzles 16 and at the same time to the injector 30. Combustion air is also supplied to the combustion chamber 18 and to the air vent 66 in the injector 30. The main fuel nozzles 16 produce a fuel spray into the primary zone 20, and high voltage supplied to the electrostatic nozzle 50 causes the nozzle 50 to produce a finely atomized fuel spray 48 into the injector orifice 64. When the exciter applies a high voltage/current pulse to the electrode 76, a plasma arc 56 is created that ignites the fuel from the electrostatic nozzle 50, producing an initial combustion effect 40 that is injected into the primary zone 20 and ignites the main fuel/air mixture 24, thus initiating the main fuel combustion process in the combustor 10. After combustion begins, the injector 30 may not be needed and the exciter and fuel flow through fuel line 38 can be disabled. The system offers improved flexibility since the electrostatic nozzle 50 and igniter 52 can also be operated independently. The electrostatic nozzle could be required to remain on to enhance combustor stability, and may require a separate control system to vary the nozzle operating voltage and thereby directly control the droplet size distribution from the injector(s) which consequently provide an independent control of combustor temperature. The final operational modes for the injector/power system/control system rest with the combustor design engineers requirements for a specific engine development program.

If flame out occurs, the electrostatic nozzle has a distinct advantage over conventional pressure nozzles because it produces a finely atomized fuel spray that is not strongly dependent on fuel or air pressure or combustor pressure. Thus, engine restart, even under adverse conditions such as low temperature is much more reliable. Thus, the injector 30 combination of an electrostatic atomization nozzle and igniter provides a significantly improved way to initiate combustion and to restart the engine, even under adverse conditions. The combined nozzle/igniter injector 30 also allows an engine designer to optimize the combustor design without constraints being imposed by the ignition system requirements. In other words, with conventional ignition systems, the combustor design is compromised to guarantee reliable ignition because the igniter is located at the combustor periphery where air/fuel ratios are not optimal. Because the present invention provides an improved combustion injection technique, the position of the igniter is no longer a limitation on the combustor design.

In an engine or combustor, only one injector 30 may be required for initiating combustion, however, additional injectors can be provided for back up or combustion stabilization for example, particularly for aerospace applications.

Figure 3:
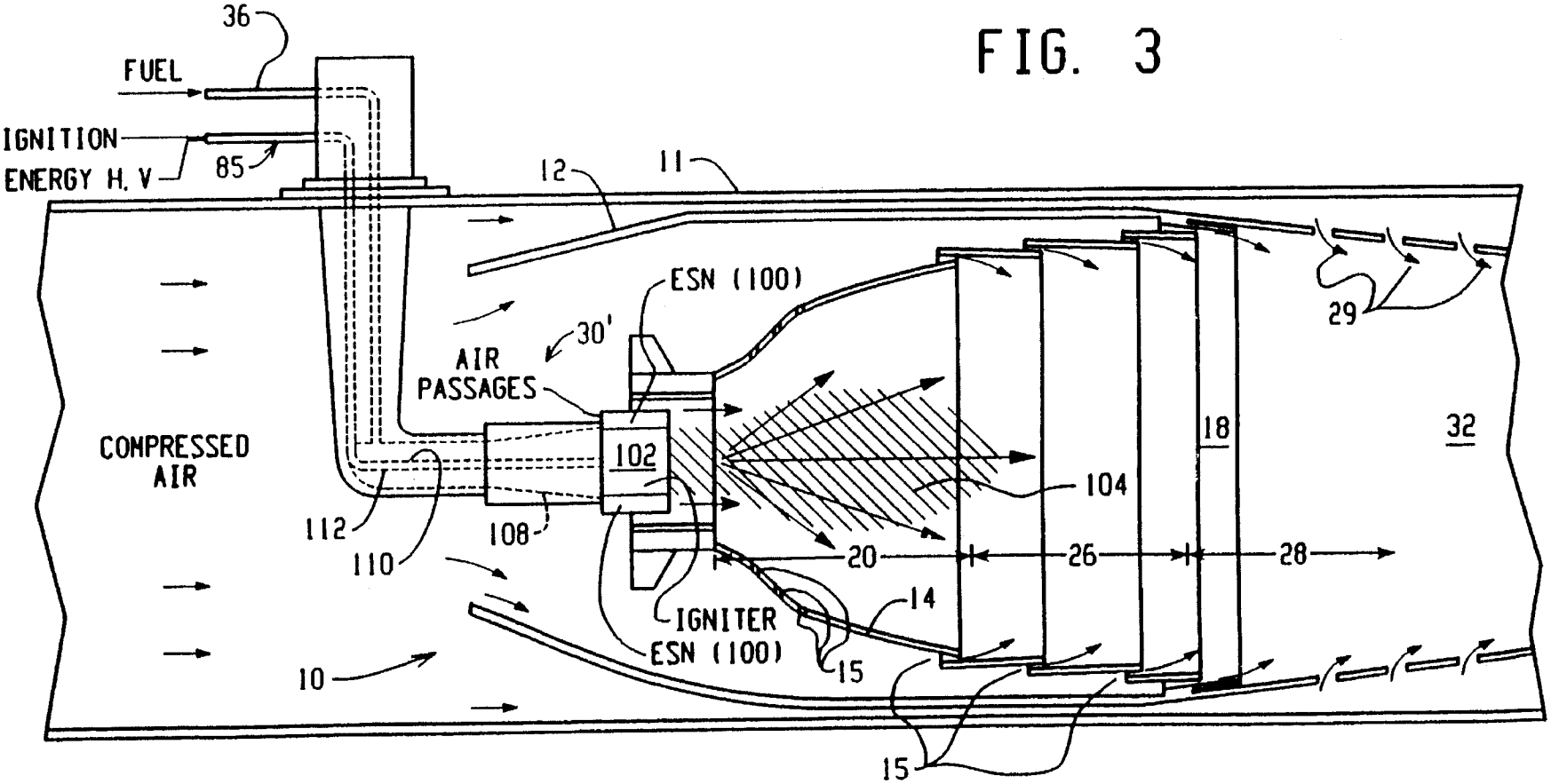
FIG. 3 is a simplified schematic of another embodiment of the invention.

FIG. 3 illustrates another embodiment of the invention which can also be used as an injector test system. In this arrangement, the main fuel nozzle 16 (FIG. 1) is replaced with an injector 30' consisting of a plurality of electrostatic nozzles 100 which surround a centrally located igniter 102. With the igniter integrally installed in the main fuel nozzle injector. 30', there is no need for the separate combustion injector or igniter mounted adjacent to the fuel nozzle. The plurality of nozzles 100 produce an atomized fuel spray 104 into the primary zone 20. As illustrated, the fuel, ESN and igniter energy inputs are connected through fittings (not shown) in the back of the nozzle assembly. Other components in the combustor are the same as in FIG. 1 and given like reference numerals.

Figure 4A:
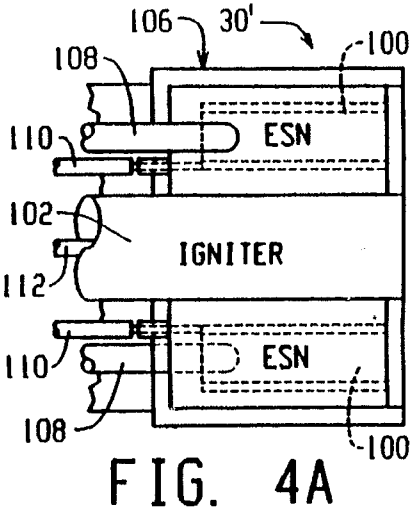
FIGS. 4A and 4B illustrate a main fuel nozzle according to the invention.
Figure 4B:
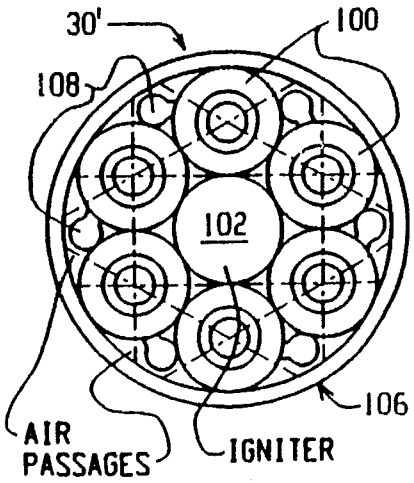

FIG. 4A shows an elevation cross-sectional view of the multiple fuel nozzle injector assembly 30', and FIG. 4B shows an end view of the same assembly. In the embodiment of FIGS. 4A and 4B, there are six electrostatic fuel nozzles 100 arranged in an annular configuration around a centrally disposed igniter 102. The nozzles 100 and igniter 102 are retained within a common housing 106. Of course, a different number of nozzles can be used depending on the fuel delivery rates required for the assembly (as specified by the engine design) and the individual fuel capacity of each nozzle (a typical fuel delivery rate for a series 18 spray triode is about 11 pph at a pressure of 110 pounds; other fuel rates of course can be used as required for the engine). The nozzles 100 can also be integrated into a single housing containing multiple orifices.

The igniter 102 may be any conveniently available igniter such as a conventional spark plug or a laser injector (as described hereinafter with reference to FIG. 7), or a laser igniter as described in my copending application for "LASER IGNITION METHODS AND APPARATUS FOR COMBUSTORS" filed on even date herewith and commonly owned by the assignee of the present invention, the entire disclosure of which is fully incorporated herein by reference, to name just a few of the options available to the designer. As shown in FIG. 4A, fuel is supplied to the electrostatic nozzles 100 via auxiliary fuel lines 108 connected to a main fuel line 36 (FIG. 3). The high voltage input is received through the nozzle assemblies 100 at terminals connected to conductors 110, which are connected to a high voltage source (not shown). A high tension lead 112 is used to supply the discharge energy from an exciter to the igniter, when such igniter is a conventional spark plug or an igniter such as shown in FIG. 2. The uniform arrangement of the nozzles 100 around the igniter 102 helps assure the initiation of combustion. The use of the electrostatic nozzles further facilitates engine start and restart even under adverse conditions. As in the embodiment of FIG. 1, the electrostatic nozzles are preferably as described in the referenced electrostatic nozzle patents issued to Kelly. Other electrostatic nozzle designs could also be used, of course.

Figure 5:
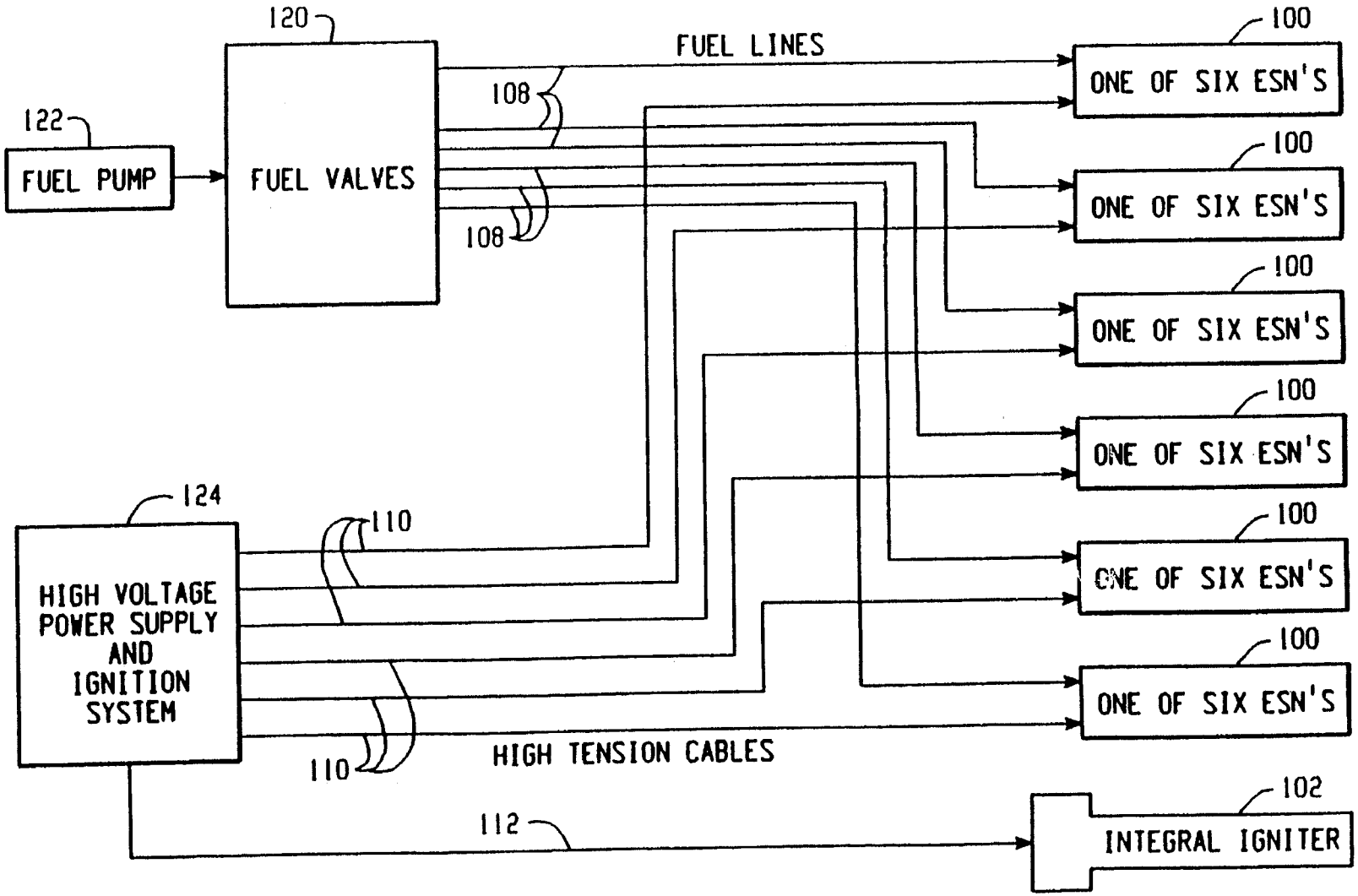
FIG. 5 is a schematic drawing of a preferred control circuit for the main fuel nozzle design shown in FIG. 3 and 4A, 4B.

FIG. 5 is a schematic representation of a preferred control circuit for the main fuel nozzle assembly of FIGS. 3 and 4. In this control circuit arrangement, a plurality of fuel valves 120 (preferably one for each of the electrostatic nozzles 100) are connected to a conventional engine fuel pump 122. The valves 120 feed fuel from the pump 122 to the nozzles 100 via the auxiliary fuel lines 108. The fuel valves 120 can be controlled in a conventional manner. The high voltage energy for the nozzles 100 is provided by conductors 110 connected to a high voltage supply and ignition controller system 124. The circuit 124 can be provided with a selector circuit ignition system (not shown in detail) which, under control of an electronic controller such as a main fuel supply controller, or a stand alone nozzle controller, selects one or more of the nozzles to supply the initial fuel spray for initiating combustion. After combustion begins, the fuel controller via the circuit 124 controls whether voltage is supplied to the nozzles 100, in concert with control of the fuel valves 120, to control fuel flow through the nozzle assembly based on fuel demand. The circuit 124 can also conveniently be used with an integrated exciter circuit to supply high voltage discharge to the igniter 102 via the high tension conductor 112. In the case where a laser injector (as in FIG. 7) or a laser igniter (as described in the referenced copending application) is used in place of the plasma igniter 102, the control circuit 124 would include a laser energy source in place of the exciter. The high tension leads 112 to the igniter would be replaced by optic fibers or other optic conduits. High voltage would still be supplied to the nozzles.

Figures 6, 6A:
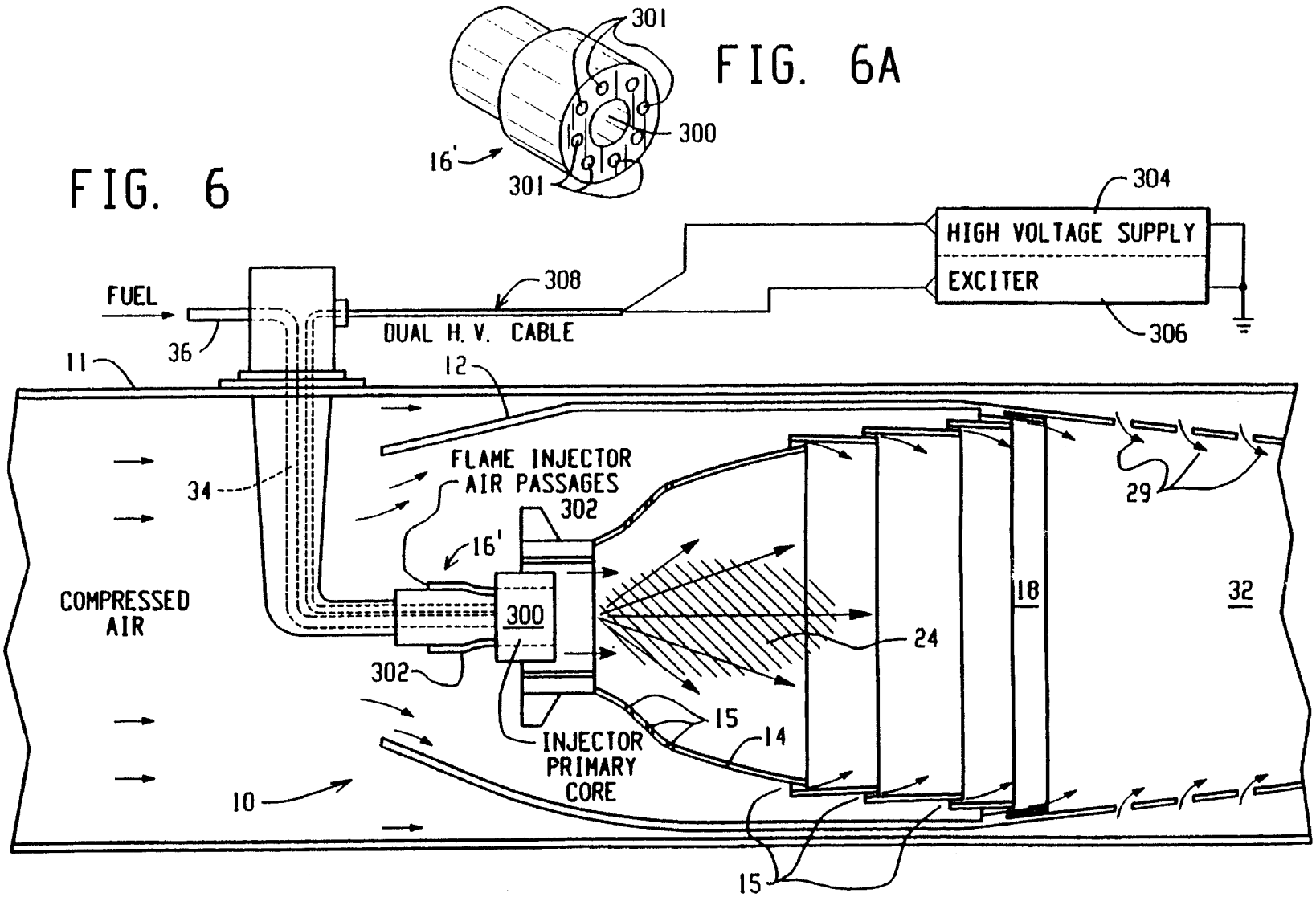
FIG. 6 is a simplified schematic representation of a portion of a combustor, in partial section, showing another embodiment of the invention therein, with FIG. 6A showing a simplified perspective of the nozzle assembly.

With reference now to FIG. 6, in this embodiment of the invention, a conventional main fuel nozzle (such as an air blast or pressure atomizing nozzle) is modified such that an injector 300, such as the type illustrated in FIG. 2, replaces the primary orifice of the main nozzle 16'. Other components of the engine and combustor are the same and are given like reference numerals. The secondary orifices are thus unchanged and provide secondary fuel supply in a conventional manner after combustion is initiated using the injector 300. As best shown in FIG. 6A, the modified nozzle 16' includes the integral igniter 300 in place of the primary orifice, and surrounded by the conventional secondary orifices 301. Secondary air passages 302 are provided to supply air to the injector 300. The injector 300, of course, includes an electrostatic nozzle supplied with fuel from the main fuel line 36.

High voltage energy from a voltage supply 304, and high voltage/current pulses from an exciter 306, are provided to the injector 300 through a shielded dual cable 308 as previously describe herein (e.g. cable 85 in FIG. 2).

Alternatively, the injector 300 can be configured with a laser igniter as described hereinafter. In such a configuration, the exciter 306 would be replaced with a pulsed laser energy source, preferably using infrared laser energy, and the exciter high tension lead would be replaced with an optic cable.

Although the electrostatic nozzle/igniter combinations of FIGS. 1–5 achieve a significant advance in combustion start and restart, I have also discovered an improved fuel ignition technique referred to herein as laser ignition, or the use of a laser igniter. According to this aspect of the invention, a laser igniter uses laser energy to ignite an atomized fuel spray, thus obviating the use of high voltage plasma plugs. The use of the electrostatic nozzles in particular facilitates the use of laser igniters because of the fine atomization (small and uniform droplet sizes) achieved by these nozzles. This is because the small droplet size substantially reduces the energy required to ignite the fuel spray, thereby lowering the amount of laser energy required. However, the laser igniter can also be used with conventional nozzles in applications where higher energy lasers are available. Another significant advantage of the laser igniter design is that there is very little energy loss from the laser source to the igniter, in contrast to the substantial energy loss between an exciter circuit and a plasma discharge plug.

Figure 7:
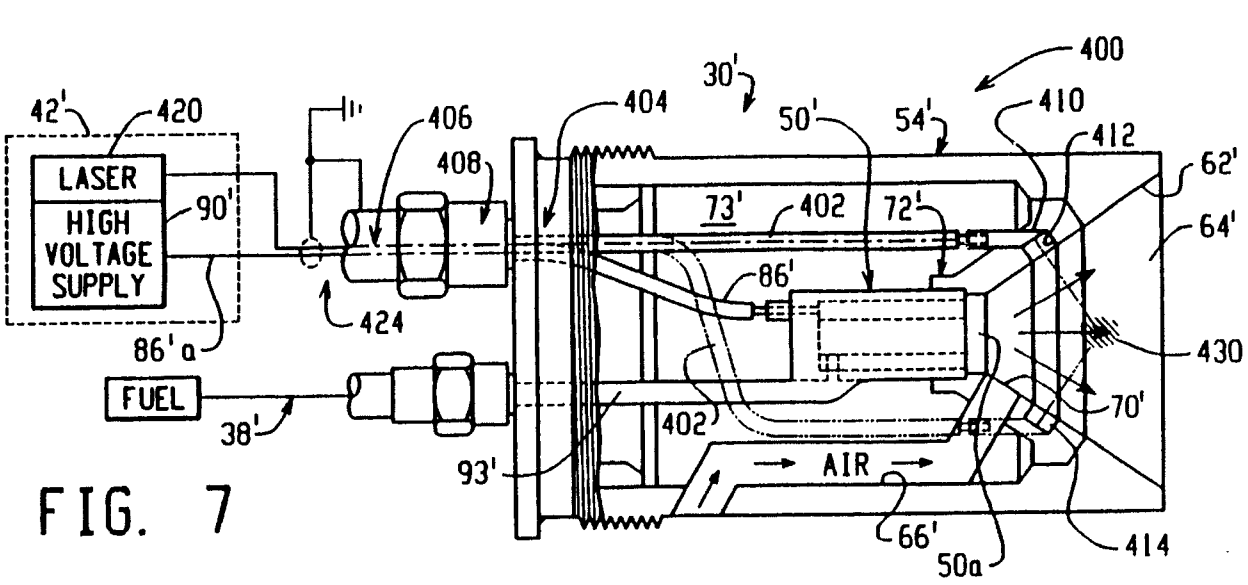
FIG. 7 is a simplified schematic representation in longitudinal section of an injector in accordance with the invention using a laser igniter.

A preferred embodiment of a laser igniter 400 used in combination with an electrostatic fuel nozzle 50' to provide an integrated injector 30' is illustrated in FIG. 7. The injector 30' is similar to the injector 30 of FIG. 2 with respect to the housing and nozzle. Thus, like reference numerals (with a prime ') are used for like components. However, in the embodiment of FIG. 7, the plasma igniter (52) is replaced with optics to realize the laser igniter portion of the injector.

Fuel is delivered to the electrostatic nozzle 50' via the fuel line 38' and cavity 93'. High voltage energy for the nozzle 50' is provided by a high voltage source 90' through a high voltage lead **86*a'* connected to the nozzle high voltage conductor 86'. As with the injector 30 of FIG. 2, the housing 54' is preferably hermetically sealed and filled with dry nitrogen or other inert gases. The nozzle 50' is supported at one end in the ceramic spacer 72' with the spacer 72' and housing 54' having a frustoconical surface 62' that defines an injector outlet orifice 64'**.

An optic fiber or bundle of optic fibers 402 extend through the housing 54'. The housing 54' can be filled with alumina packing 73' or formed of a single ceramic piece. In either case, the optic fiber(s) 402 extend through tubular openings or provide tubular passage through the housing. An input end 404 of the optic fibers are optically coupled to an optic cable 406 by means of a suitable fitting or ferrule-type connector 408. A preferred optical cable and connector arrangement is described in U.S. patent application Ser. No. 844,112 filed on Mar. 2, 1992 and commonly owned by the assignee of the present invention, the entire disclosure of which is fully incorporated herein by reference. The connector 408 may include an optical plug, lens or other convenient means for coupling laser energy from the cable 406 to the igniter fiber(s) 402. An output end 410 of the igniter fiber(s) 402 terminates at an opening 412 that extends through the ceramic spacer 72'. The spacer opening 412 may retain a lens or optic window 414, for example, made of sapphire, for additional focussing of the laser beam and added sealing of the injector from the combustion chamber.

Additional optic fiber(s) 402 can be provided about the nozzle 50', as shown in phantom in FIG. 7. Alternatively, the fibers 402 need not be used, but instead a "line of sight" lens arrangement can be utilized to focus the laser energy into the orifice 64'. In such a case, the tubular openings formed for the fibers 402 would be empty or filled with the inert gas used in the hermetically sealed unit 30'. The lensing arrangement would be disposed near the input end 404, directing the beams down the tubular opening to another lens or window near the orifice, such as at 412.

Another alternative is to use a light pipe, such as a sapphire rod to transmit light through the housing 54', such as is shown and described in my copending LASER IGNITION patent application referenced herein. This light pipe design is less preferred, however, for the injector 30' design of this invention due to the expected high thermal gradients caused by proximity of the injector 30' to the combustion chamber.

The laser igniter 400 uses laser energy produced by a laser energy source 420. The laser source launches collimated laser energy into the optic cable 406. Thus, the laser source 420 can be remotely disposed away from the injector 30' without significant loss of laser energy. The preferred laser systems of choice are; straight laser diode system or a laser diode pumped crystal/glass rod laser system. In any case the primary laser element preferably will be a laser diode such as model no. OPC-AOxx-yyy-CS available from OPTO Power Corporation (where "xx" represents the power in watts, and "yyy" represents the wavelength in nanometers). Of course, any conveniently available laser diode array technology can be utilized at the desired power and wavelength. The straight laser diode system typically consists of a control system, pulse power supply, laser diode array with heat sink, and a lensing system. Simply, this system utilizes the output of a multi laser diode array and a lensing system to produce a collimated laser beam. The control system fires the pulse power supply which energizes the laser diode array resulting in a pulsed laser beam. The control system sets the pulse length, repetition rate and monitors system performance to protect the laser diode array from adverse operating conditions, primarily over temperature conditions. The laser diode pumped crystal/glass rod laser system consists of a control system, pulse power supply, laser diode array, crystal/glass lazing medium (examples are—doped YAG crystal, HO:YLF, and doped phosphate laser glass to name a few) and a lensing system. The multi laser diode array is pulsed such that photon energypackets are projected into the crystal/glass rod structure. These photon energy packets are timed such that the total stored energy in the crystal/glass rod add until the rods lasing threshold is reached. At this point the rod lases and emits a laser beam pulse of greater intensity than any of the individual laser diode pulses. The lensing system and control systems operate basically to provide the same functions as in the straight laser diode system. In both instances the laser beam pulses are transmitted to the injector 30' via the fiber optic cable 406 with an integral cable 424 having the fiber optic cable and high voltage lead to operate the electrostatic fuel nozzle. The laser pulses preferably are approximately 10 nanoseconds to 100 milliseconds in duration, with a wave length of between 800 nanometers and 10,000 nanometers and a peak energy between 0.01 joules and 10 joules, depending on combustor design parameters. The selection of the laser diode determines the wavelength of laser emission.

As illustrated in FIG. 7, preferably the optic cable 406 and the high voltage conductor **86*a'* (used-for delivery of high voltage to the nozzle 50') are routed through a common EMI shielded cable 424**, although in some applications such shielding may not be needed.

In operation, the laser igniter 400 is used to ignite the fuel spray from the electrostatic atomizing nozzle 50'. This initial combustion is injected into the primary zone so as to initiate combustion of the main fuel supply. Preferably, the laser energy converges as at 430 (exaggerated for clarity in FIG. 7) just downstream of the air orifice 70'.

The injector 30' with the integral laser igniter 400 can be installed in a combustor similar to the injector 30 shown in FIGS. 1 and 2. Alternatively, the injector 30' can be installed in the main fuel nozzle at the primary orifice similar to the embodiment shown in FIG. 6. In the latter case, of course, the exciter 306 would be replaced by the laser source 420, and the dual high voltage cable 308 would be replaced by the high voltage/optic cable 422 (FIG. 7). The laser based injector 30' could also be used in the embodiment illustrated in FIGS. 3, 4A and 4B in lieu of the igniter 102. For all of these embodiments, as well as other uses of the laser injector 30' in place of a plasma or glow plug igniter, the laser igniter is expected to provide at least an order of magnitude improvement in reliability over the plasma type igniter. This will effectively improve the reliability of the injector such that it approaches the reliability of the main fuel nozzles. Thus, when the main fuel nozzle and injector are combined into a single integral unit, the igniter will not have to be replaced any earlier than the normal fuel nozzle replacement schedule.

It is preferred that the laser system produce laser light in the infrared wavelength region, such as 800 nm to 10,000 nm. The combustion process, particularly for aircraft fuels, produces by products and varnish that absorb laser light in the ultraviolet wavelength region. Therefore, it is preferred to use light in this infrared region. Infrared light is suitable for igniting fuel, and in fact can be accomplished at relatively low energy levels when used in combination with an electrostatic atomization nozzle.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

I claim:

1. A method for igniting fuel in a combustor comprising the steps of:

a. mixing fuel from a main fuel supply with air to produce a main air/fuel spray, and delivering the main air/fuel spray into the combustor;

b. using an electrostatic nozzle to atomize fuel provided from a second fuel supply to produce an atomized fuel spray separate from the main air/fuel spray;

c. using an igniter to ignite said separate atomized fuel spray; and d. using the ignited electrostatically atomized fuel spray to ignite said main air/fuel spray in the combustor.

2. The method of claim 1 wherein the step of using an electrostatic nozzle to atomize fuel includes the step of using another electrostatic nozzle as a main fuel supply to the combustor.

3. The method of claim 1 wherein said combustor comprises a flow through combustor.

4. The method of claim 3 wherein the flow through combustor is part of a gas turbine engine.

5. The method of claim 1 further comprising the step of using an electrical energy source to control fuel atomization from said electrostatic nozzle during combustion of the main air/fuel spray.

6. The method of claim 1 further comprising the step of using laser energy to ignite said separate atomized fuel spray.

* * * * *